US009636562B2

(12) United States Patent
Way

(10) Patent No.: US 9,636,562 B2
(45) Date of Patent: May 2, 2017

(54) GOLF PUTTING TRAINING AID

(71) Applicant: Brian Matthew Way, North Wales, PA (US)

(72) Inventor: Brian Matthew Way, North Wales, PA (US)

( * ) Notice: Subject to any disclaimer, the term of this patent is extended or adjusted under 35 U.S.C. 154(b) by 0 days.

(21) Appl. No.: 15/193,510

(22) Filed: Jun. 27, 2016

(65) Prior Publication Data

US 2016/0375335 A1 Dec. 29, 2016

Related U.S. Application Data

(60) Provisional application No. 62/184,690, filed on Jun. 25, 2015.

(51) Int. Cl.
*A63B 69/36* (2006.01)
*A63B 69/00* (2006.01)

(52) U.S. Cl.
CPC ..... *A63B 69/0057* (2013.01); *A63B 69/36* (2013.01); *A63B 2069/0062* (2013.01)

(58) Field of Classification Search
USPC ..... 473/207, 215, 270–277
See application file for complete search history.

(56) References Cited

U.S. PATENT DOCUMENTS

| | | | | |
|---|---|---|---|---|
| 3,190,658 | A * | 6/1965 | Kane | A63B 69/3676 473/227 |
| 4,045,033 | A * | 8/1977 | Schuman | A63B 69/0059 473/266 |
| 4,088,326 | A | 5/1978 | Bifulco | |
| 4,706,957 | A | 11/1987 | Jackson | |
| 5,016,885 | A | 5/1991 | Quigley | |
| 5,026,066 | A * | 6/1991 | Kane | A63B 69/3676 473/227 |
| 5,203,567 | A * | 4/1993 | Erlinger | A63B 69/0059 473/276 |
| 6,179,756 | B1 * | 1/2001 | Bertolucci | A63B 21/0023 482/131 |
| 6,332,845 | B1 | 12/2001 | Priestley | |
| D519,587 | S * | 4/2006 | McCarty | D21/662 |
| 7,578,773 | B2 * | 8/2009 | Gronda | A63B 21/00069 482/111 |

FOREIGN PATENT DOCUMENTS

GB 2284556 A 6/1995

* cited by examiner

*Primary Examiner* — Nini Legesse
(74) *Attorney, Agent, or Firm* — Cozen O'Connor

(57) ABSTRACT

A golf swing training aid having opposing concave pads suitable for being positioned between the legs of a user and comprising an attachment mechanism attached to the training aid that secures an alignment apparatus.

9 Claims, 6 Drawing Sheets

GOLF PUTTING TRAINING AID

PRIORITY CLAIM

This application claims the benefit of U.S. Provisional Application Ser. No. 62/184,690, filed Jun. 25, 2015, the disclosure content of which is hereby incorporated by reference in its entirety.

FIELD OF THE INVENTION

Presently disclosed embodiments are related to a golf swing training aid, primarily focused on putting.

BACKGROUND

There are literally dozens, if not hundreds of golf training devices, each seeking to aid players in improving their golf game. However, devices for improvement of putting are fewer in number, perhaps, as recreational golfers feel that putting is easy or routine. However, many recreational and even professional golfers require trainings aids to improve body movements and to improve alignment for putting.

With regard to the training aids designed to aid or improve a player's putting stroke, most are directed to the movement of the upper body, the hands and arms, the path in which the golf club travels, and centeredness of contact. However, little attention has been given to the stability of the lower body during the putting stroke. Ideally, the lower body (below the waistline) will remain immobile during the back swing and on the forward swing until the golf putting stroke is completed.

The training aids for the lower body commonly use a fabric/elastic strap to restrict/ensure proper movement throughout the back swing. However, such a training aid does not allow for immobilization of the lower body throughout the entire putting stroke. Furthermore, these devices do not allow for differences in stance widths, aiming, and set up correction in all cases.

Examples which have been proposed to control the movement of the player's legs during the swing are disclosed in GB 2,284,556 (BUCKINGHAM); U.S. Pat. No. 5,016,885 (QUICGLEY); U.S. Pat. No. 4,706,957 (JACKSON) and U.S. Pat. No. 4,088,326 (BIFULCO); U.S. Pat. No. 6,332,845 B1 (PRIESTLEY).

The latter three documents disclose training aids where the player's knees (or lower legs) are bound together at a fixed spacing. In GB 2,284,556 (BUCKINGHAM), the device is fitted between both knees below the knee joints, with side supports, secured by releasable straps, where a plastic swivel bar with a center pivot interconnects the side supports and allows some controlled movement between the legs. While some movement between the knees can occur during the swing, both knees mist be fastened to the device, generating an unnatural movement. Practicing such unnatural movements leads to poor habits and potentially injury in some cases.

Furthermore, such a training aid does not allow for aiming, set up correction, or restriction of leg movement on the forward swing. In sum, these training aids provide for unnatural set-up and practice of the putting swing. Therefore, new training aids are necessary that are particularly suited to putting training aids.

SUMMARY

It is an object of the present invention to provide a training aid which keeps the lower body stable until the putting stroke is completed. In a broad aspect, the present invention resides in a swing training aid for golf comprising: A tube-like body having respective first and second end positions engageable with a player's legs at, or adjacent, to the player's knee; and wherein, the body is variable in length and comprising components which inter-connect by way of a threaded bolt to adjust the size of the training aid.

It is a preferred embodiment, disclosed herein is a training device comprising a base, having opposing compression members having a threaded end and a concave end and an attachment means to secure an alignment rod to assist in set up and alignment of the hips, knees, and feet while putting.

In a further embodiment, disclosed herein is an adjustable training device comprising a pair of opposing lunate shaped member and containing an internally threaded opening in the narrow end of the lunate shaped member in which a threaded bolt from a first lunate shaped member can be inserted and threaded onto the second lunate shaped member, wherein such members can be rotated on the threaded bolt to adjust the width of the training device.

In one preferred embodiment, a pair of lunate members are inter-connected; at one end of each lunate member is concave engagement face and the other end is a connection feature. The pair of lunate members are connected together at the connection features with connection rod, such that the concave engagement faces are positioned in opposing directions. The concave engagement face is lined with gel or rubber padding to allow for grip and comfort and are intended to be compressed between the knees or just above the knee to maintain the training aid in position. Positioned at the top of each of the lunate members is a U-Shaped connection clip, suitable for securing a positioning rod parallel to the connection rod.

Preferably, in certain embodiments, the connection rod is a threaded member, and being engaged to the connection feature on each of the lunate members will allow for three hundred and sixty degree rotation, both clockwise and counter clockwise, and adjust via the threaded member to allow for the preferred spacing between the knees.

Preferably, in certain embodiments, a first lunate shaped member and a second lunate shaped member will have an attached or adjustable clip on the outside edge to allow for the attachment of an alignment rod to aid in proper set up and alignment of the hips, knees, and feet.

A golf swing training aid to stabilize the lower body throughout a putting stroke, while offering an alignment option comprising: an elongate body with first and second compression members and a threaded member, wherein the first and second compression members have a first end comprising a receptacle for receiving the threaded member and an opposing end having a concave face, and an adjustable connection engaging the receptacle of said first and second members.

In a preferred embodiment, a golf swing training aid to stabilize the lower body throughout a putting stroke comprising: an elongate body comprising a first and second member, wherein each member comprises a concave end and a threaded end, and a threaded member for connecting said first and second members; and wherein said first and second members are secured together with said threaded member and positioned between a player's left and right legs so that the concave ends of said first and second members are compressed by the legs just above the left and right knee joints of said legs, and wherein an alignment rod is positioned with an attachment means to be parallel to the threaded member, and wherein the player's legs are stabilized throughout the entirety of the putting stroke.

A method for training a golf putting stroke comprising: positioning golf swing training aid between the knees wherein said training aid comprises: an elongate body with a first and second lunate shaped compression members, a threaded member, and an alignment rod, wherein the first and second lunate shaped compression members comprise a compression pad disposed of on the lunate shaped end of the compression member and a threaded receptacle for receiving a threaded member at the opposing narrow end of the lunate shaped member, and further comprising a U-shaped clip disposed of at the widest portion of the lunate shaped member, wherein said U-shaped opening is disposed of parallel to the threaded receptacle and suitable for receiving an alignment rod in said U-shaped openings; rotating said lunate shaped members to increase or decrease the distance between the opposing concave ends; attaching said alignment rod into said U-shaped clips; positioning said first and second concave ends between a player's left and right legs so that first and second ends are secured just above the left and right knee joints of said legs, wherein said alignment rod is extended beyond the knees of the user; aligning the alignment rod towards the target; and performing a putting stroke, wherein the player's legs are stabilized throughout the entirety of the putting stroke.

A golf swing training aid to stabilize the lower body throughout a putting stroke comprising: an elongate body with a first and second lunate shaped compression members, a threaded member, and an alignment rod, wherein the first and second lunate shaped compression members comprise a compression pad disposed of on the lunate shaped end of the compression member and a threaded receptacle for receiving a threaded member at the opposing narrow end of the lunate shaped member, and further comprising a U-shaped clip disposed of at the widest portion of the lunate shaped member, wherein said U-shaped opening is disposed of parallel to the threaded receptacle and suitable for receiving an alignment rod in said U-shaped openings.

DETAILED DESCRIPTION OF PREFERRED EMBODIMENTS

All references cited herein are hereby incorporated by reference in their entirety.

The materials, methods, and examples presented herein are intended to be illustrative, and not to be construed as limiting the scope or content of the invention. Unless otherwise defined, all technical and scientific terms are intended to have their art-recognized meanings. Furthermore, the various depictions of the embodiments may be combined with one or more of the other features in other embodiments, as intended by the Applicants.

As used herein, the term "about" is intended to encompass a range of values ±10% of the specified value(s). For example, the phrase "about 20" is intended to encompass ±10% of 20, i.e. from 18 to 22, inclusive.

Embodiments disclosed herein are particularly suitable for a golf putting training aid. The training aid, as designed, restricts lower body (below the waistline) movement, while also providing means for attachment of an alignment rod which, together, assists in positioning a user with the proper set up and alignment of the hips, knees, and feet. This invention not only is designed to eliminate lower body movement throughout the putting stroke, but also provide proper alignment and set up position when an alignment rod is attached.

When an alignment rod is attached to the training aid and the training aid is properly secured above the player's knee joints; and the player's lower body should happen to move in any direction throughout the putting stroke, the alignment rod will move along with the player's body providing a visual guide as to how much and in which direction the player's body has moved. Accordingly, there is a real-time feedback to the user with regard to the body movement, thus allowing the user to correct the improper movement and to practice proper form. Without the alignment rod 46, some movements of the lower body are small enough that they are difficult to perceive by the user. Thus, the alignment rod 46 provides for an easily visual feature to identify improper lower body movement, and through repeated practice strokes with the putting training aid, reduction and elimination of lower body movement can be achieved. Through repeated practice and muscle memory, the putting training aid can dramatically improve the putting stroke of users.

Figure 1:
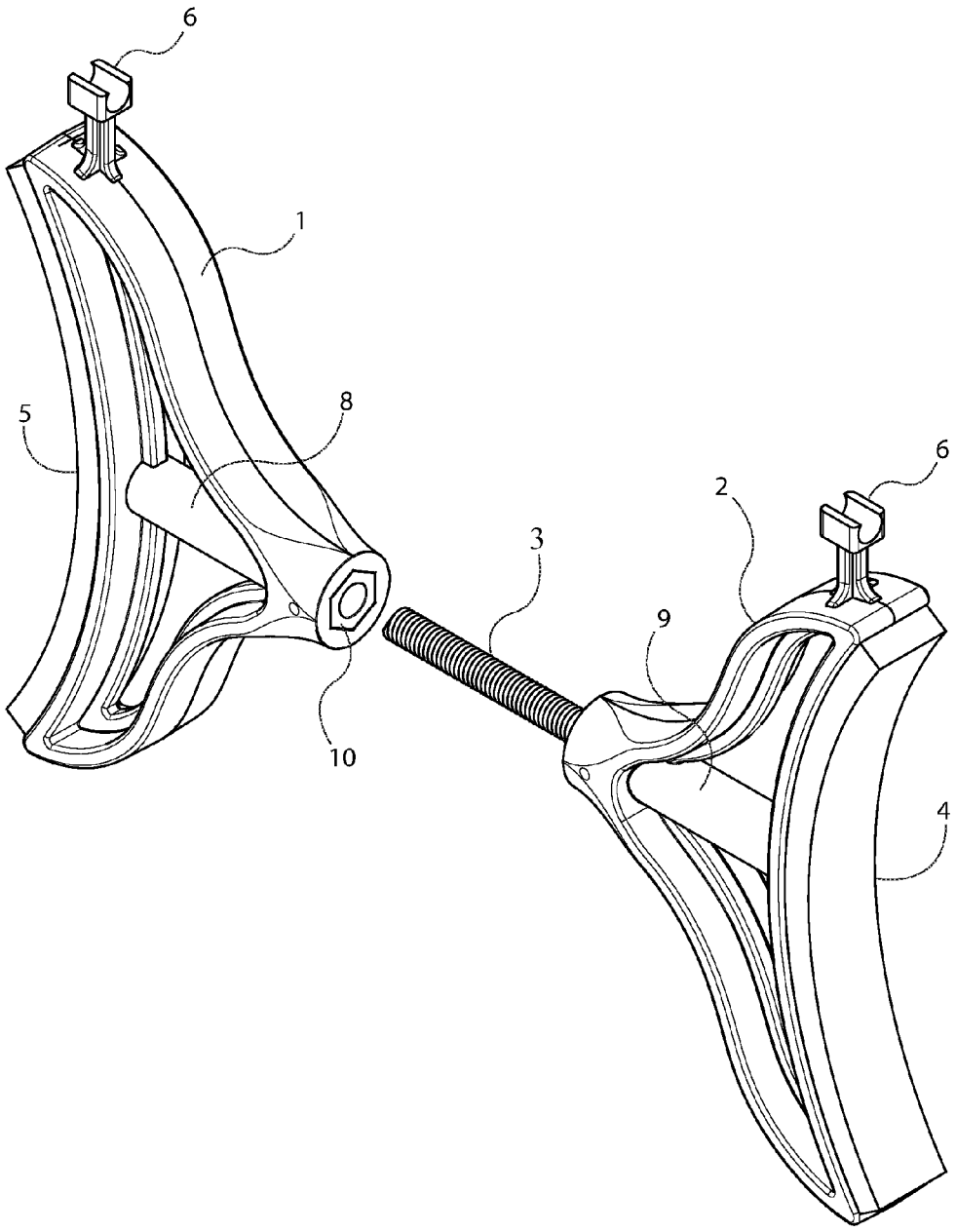
FIG. 1 depicts a perspective view of an embodiment of the golf training aid in an exploded view.

Referring to FIG. 1, the training aid 11 comprises two lunate shaped compression members 1 and 2. The lunate shaped compression members are preferably molded from suitable plastics material or other suitable material to maintain rigidity. As depicted in FIG. 1, the lunate shaped compression members have a threaded end 10 and an opposing end having a concave shape. The left compression member 1 comprises an internally threaded compartment 8. The internally threaded compartment 8 of the left compression member 1 accepts a threaded bolt 3 within said compartment 8, which allows the left and right compression members to be threaded together.

As depicted in FIG. 1, the right compression member 2 is attached to the threaded bolt 3, wherein a portion of the bolt is within the internal compartment 9. In certain embodiments, the internal compartment 9 may comprise a set of corresponding threads, wherein the threaded bolt 3 can simply be threaded into the internal compartment 9. This allows for each the left and the right compression members to revolve around the threaded bolt 3 for expansion of the device based on size of the user.

In other embodiments, the right internal compartment 9 may simply adhere to the threaded bolt 3 to prevent its movement, and thus only the left compression member 1 would revolve around the threaded bolt 3. Accordingly, in either embodiment, by rotating on or both of the compression members (1, 2) the compression members move closer to or further away from one another. Using ordinary threaded bolts, a clockwise turn of the compression members would secure closer to one another, while rotation in a counter-clockwise direction would move the compression members away from one another. Accordingly, the training aid can be modified to fit users of all sizes by rotating the members to extend or narrow the training aid as needed for fit.

The lunate shape of the compression members 1 and 2 provides a wide end for receiving of a compression pad 4 and 5. This concave end provides a wide based for compression between the legs, whereas the narrow end of the lunate shaped member is shaped to reduce weight and bulk of the putting training device. However, other modifications to the lunate shaped member are suitable such as a triangular, box, rectangular, oblong, crescent and the like. The appropriate shape retains a concave end for comfortable fit and compression against the knees of the user and an opposing end for accepting a threaded member to quickly and easily modify the size of the device.

A compression pad 4 is secured to the outer concave surface of the left member 1 via an adhesive. The purpose of the concave surface is that the compression pad is intended to be compressed against the inside of the leg of a user, and the concave surface provides for a stable shape for squeezing the device 11 between the legs of a user. A second compression pad 5 of similar or identical material, is secured to the outer surface of the opposing right member 2. The compression pads 4 and 5 are preferably made of a rubber or foam like material that can slightly compress upon a force applied, but return to shape after the force is removed. Suitable natural or synthetic based rubbers and foams are known to those of ordinary skill in the art.

At the top of each of the left 1 and right members 2 is a clip for securing a rod 46 thereto. The clips are positioned so that a rod 46 secured thereto will be parallel to the threaded bolt 3. The rod 46 provides for a visual identification of movement of the lower half of the body 50 by a user. (See FIG. 7).

Figure 2:
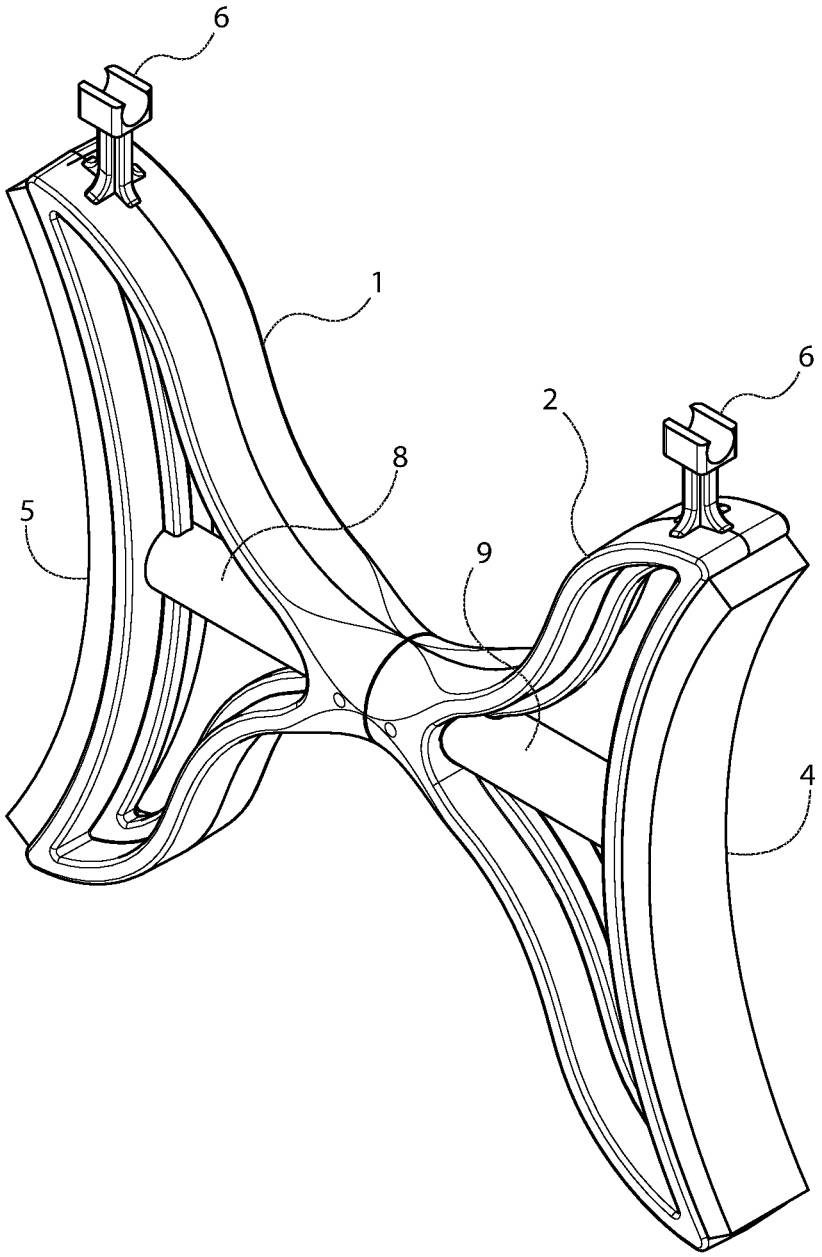
FIG. 2 depicts a perspective view of an embodiment of the golf training aid.
Figure 3:
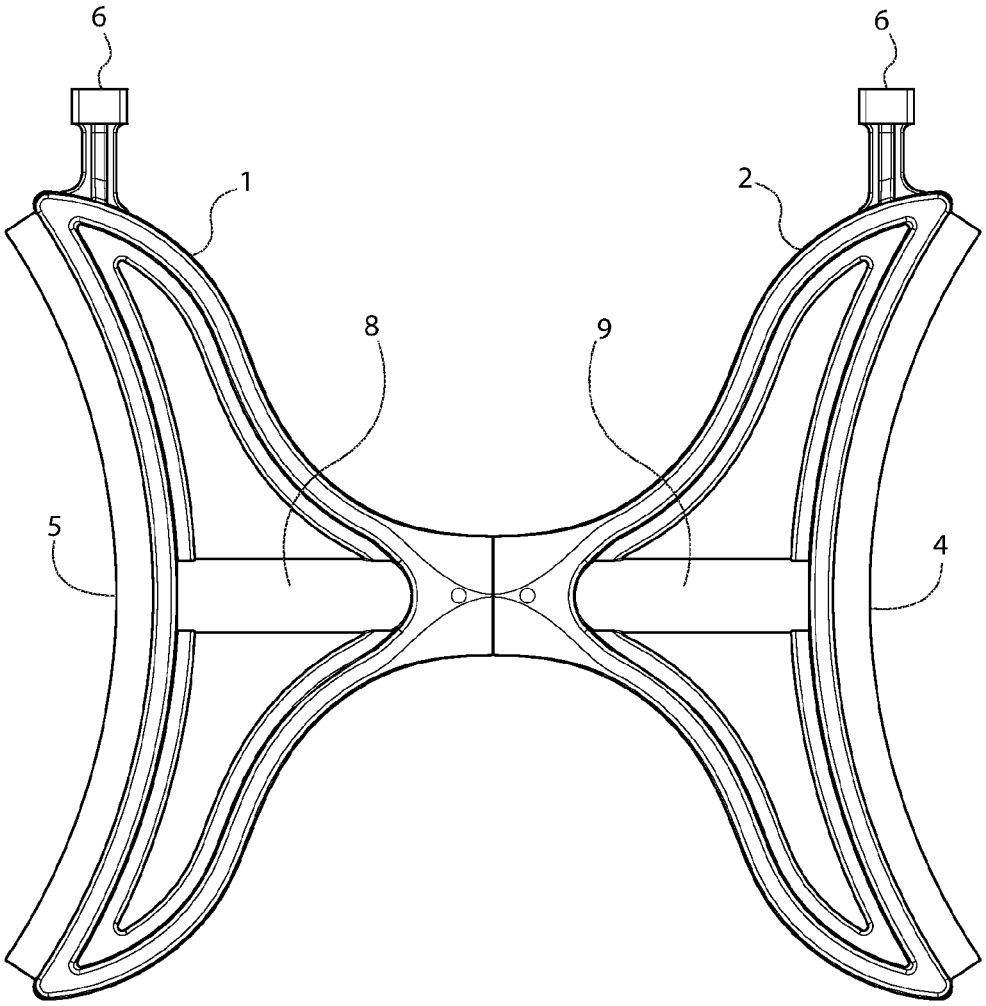
FIG. 3 depicts a side plan view of an embodiment of the golf training aid.

FIG. 2 defines the golf training device 11 in its smallest position, wherein the threaded bolt 3 is completely positioned within the internal compartments 8 and 9. FIG. 3 provides a side profile view of the golf training device 11 in this closed position. The left and right sides are identical in preferred embodiments.

Figure 4:
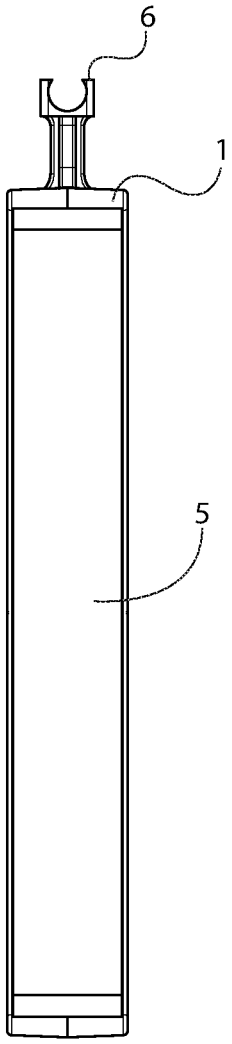
FIG. 4 depicts an end profile view of an embodiment of the golf training aid, the left and right sides being equivalent in preferred embodiments.

FIG. 4 provides an end view of the golf training device 11 from the left side, with the left concave portion of the compression pad 5 facing forward. The left and right members 1 and 2 would appear identical from this end view.

Figure 5:
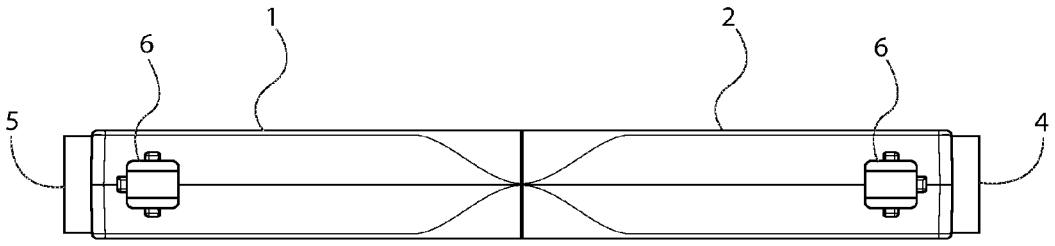
FIG. 5 depicts a top plan view of an embodiment of the golf training aid.
Figure 6:
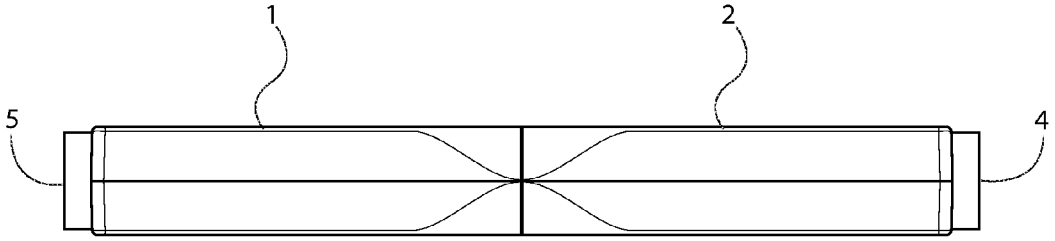
FIG. 6 depicts a bottom plan view of an embodiment of the golf training aid.

FIG. 5 provides a top down view of the golf training device 11, which shows the orientation of the compression pads 4 and 5 on each end and the position of the clips 6 on the top portion of each of the left and right members 1 and 2. FIG. 6 provides a bottom view, which is nearly identical to the top down view except for the fact that there are no clips 6 on this side of the device.

Figure 7:
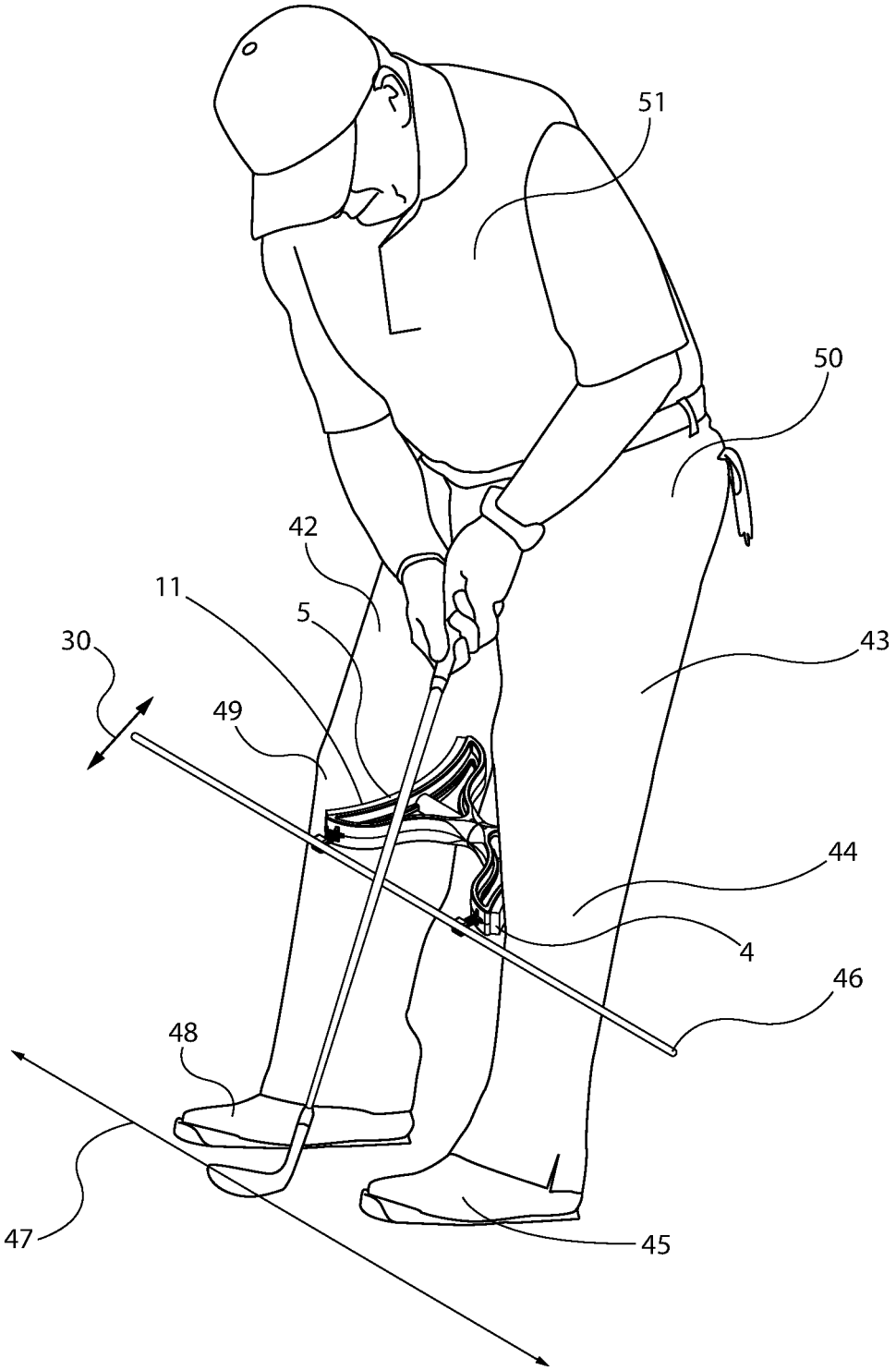
FIG. 7 is a schematic side view showing a right hand golfer, at his stance, with the aid in position and alignment rod attached during an improper forward stroke.

Referring to FIG. 7, the training aid 11 is fitted between the player's knees 49 and 44, just above the knee joints. The player will use their left leg 43 and right leg 42 to apply slight inward pressure to stabilize the training aid 11. The pressure is applied to the compression pads 4 and 5, which thus secures the training aid in place between the legs, so long as pressure is applied to each of the pads. Once pressure is released from one pad, the training aid will displace. In order to maintain alignment, light pressure must remain on the aid during the stroke.

In use of the device, during the player's back stroke (along the swing path 47) and until the back stroke is completed, slight inward pressure from the player's left leg 43 and right leg 42 is applied to the training aid 11 to stabilize the player's lower body 50 (below the waistline). During the player's forward stroke and until the forward stroke is completed, slight inward pressure from the player's left leg 43 and right leg 42 is applied to the training aid 11 to stabilize the player's lower body 50.

The alignment rod 46 can be attached to the training aid 11 via clips 6. The clips are depicted as a U-shaped feature extended away from the top of the lunate shaped body. The appropriate clip mechanism may be modified based on other suitable options as known to one of ordinary skill in the art. The simple U-shaped clip, however, allows for ease of fit of readily available and lightweight rods for attaching to the putting training aid 11. This alignment rod 46 is used as a guide to help the player's upper legs 42 and 43, knees 44 and 49, and feet 45 and 48 line up parallel with one another. In further embodiments, the alignment rod 24 can be secured by one of several means known in the art, including snaps, threaded fasteners, hook and loop material, adhesives, holes, and the like. Accordingly, the alignment rod is selectably attached to the training aid.

The alignment rod 46 is positioned parallel to the threaded bolt 3 and provides for a quick visual identification of the positioning of the body with regard to a target. Indeed, the putting training aid 11 with the alignment rod 46 in position can quickly provide feedback to a golfer about the appropriate line and positioning of the user's lower body.

Once the player's legs, legs 42 and 43, knees 44 and 49, and feet 45 and 48 are aligned parallel to the alignment rod 46 and towards the target hole, the player then begins their back stroke along the path 47. The stroke is performed with the upper body moving as if a pendulum, with the lower body remaining stable. If the player's upper legs 42 and 43, knees 44 and 49, and feet 45 and 48 move during the back stroke, the alignment rod 46 will move from its original position of parallel to the legs, knees and feet, and rotate along the rotation path 30. Any movement along the rotation path 30 indicates a movement of the lower body that is improper during the back stroke.

Regardless of movement of the alignment rod 46 on the backstroke, once the player's upper legs 42 and 43, knees 44 and 49, and feet 45 and 48 are aligned parallel to the alignment rod 46, the player then begins their forward stroke, along the stroke line 47. If the player's upper legs 42 and 43, knees 44 and 49, and feet 45 and 48 move during the forward stroke, the alignment rod 46 will again move from its original position of parallel to the upper legs 42 and 43, knees 44 and 49, and feet 45 and 48 and will rotate along the rotation path 30. Any movement along the rotation path 30 indicates movement of the legs and indicates an improper putting stroke during the forward stroke.

Therefore when the training aid 11 is used correctly, the upper legs 42 and 43, knees 44 and 49, and feet 45 and 48 stay in a parallel position to the alignment rod 46 throughout the entire back and forward stroke 47. This produces little to no movement of the alignment rod 46 along the rotation path 30. Accordingly, when maintaining the proper alignment of the hips, knees, and feet, a player can practice and engage muscle memory to improve the putting stroke. Continued and repeated strokes where the alignment rod 46 does not rotate, indicates the proper stroke was performed and repeated use of such stroke generates muscle memory to perfect the putting stroke.

The alignment rod 46 can be removed from the training aid 11 in certain embodiments. Without the alignment rod 46 the device still seeks to force the player to immobilize their lower body, but it is more difficult to see movement of the lower body without the alignment rod 46 in place.

In preferred embodiments, the putting training aid 11 therefore comprises a pair of lunate shaped compression members and a threaded bolt, wherein the lunate shaped members each comprise a U-shaped clip at the top of the lunate shaped member for receiving a connection rod, wherein the lunate shaped members can be rotated around the threaded bolt to increase or decrease the distance between the concave ends.

The putting training aid therefore can be utilized in methods for improving the putting stroke of a user comprising: compressing a training aid between the knees to determine sizing; adjusting the sizing of the training aid by rotating one or both lunate shaped members to the appropriate size; attaching an alignment rod to the U-shaped clips on the top of each lunate shaped member; compressing the training aid between the knees with the alignment rod extending in front of the knees; aligning the legs of the user to point parallel to the target hole, wherein the alignment rod will point towards the target hole; swinging a putter along a swing path wherein the alignment rod indicates movement or absent of movement of the lower body, and wherein an absence of movement of the lower body indicates a proper putting stroke, and movement of the lower body indicates an improper putting stroke.

A method of generating muscle memory of a putting stroke comprises: compressing a training aid between the knees to determine sizing; adjusting the sizing of the training aid by rotating one or both lunate shaped members to the appropriate size; attaching an alignment rod to the U-shaped clips on the top of each lunate shaped member; compressing the training aid between the knees with the alignment rod extending in front of the knees; aligning the legs of the user to point parallel to the target hole, wherein the alignment rod will point towards the target hole; swinging a putter along a swing path wherein the alignment rod indicates movement or absent of movement of the lower body, and wherein an absence of movement of the lower body indicates a proper putting stroke, and movement of the lower body indicates an improper putting stroke.

The putting training aid is indicated as a device comprising the two lunate shaped members, a threaded bolt, and an alignment rod, wherein the device can be utilized in the methods described herein to practice alignment of a put, and practicing and improving putting form.

Various changes and modifications may be made to the embodiments described and illustrated without departing from the spirit of the present invention.

What is claimed is:

1. A golf swing training aid to stabilize the lower body throughout a putting stroke, while offering an alignment option comprising: an elongate body with first and second compression members and a threaded member, wherein the first and second compression members have a first end comprising a receptacle for receiving the threaded member and an opposing end having a concave face, and an adjustable connection engaging the receptacle of said first and second members, wherein the threaded member positioned such that the first compression member rotates around the threaded member to modify the distance between the opposing concave faces on opposing ends of the compression members.

2. The golf swing training aid of claim 1 wherein the concave ends of said first and second ends are positioned between a player's left and right legs so that first and second ends are secured just above the left and right knee joints of said legs, wherein the player's legs are stabilized throughout the entirety of the putting stroke.

3. The golf swing training aid of claim 1 wherein the second compression member rotates around the threaded member to modify the distance between the opposing concave faces on opposing ends of the compression members.

4. The golf swing training aid of claim 1 wherein the first member and second member have a compression pad secured to each of the concave ends of the compression member.

5. The golf swing training aid of claim 1 wherein the first compression member and second compression member have a top and bottom side, and have a U-shaped clip on the top side of each compression member, wherein said U-shaped clip is sized for accepting and securing an alignment rod within said U-shaped clips.

6. The golf swing training aid of claim 1 wherein the compression members are lunate shaped.

7. The golf swing training aid of claim 6, wherein said lunate shaped member has a narrow end, a wide end, a top side and a bottom side, further comprising a U-shaped clip secured to the top side of the wide end of the lunate shaped compression member, wherein said U-shaped clip opening is positioned parallel to the receptacle for receiving the threaded member.

8. A method for training a golf putting stroke comprising:

a. positioning golf swing training aid between the knees wherein said training aid comprises: an elongate body with a first and second lunate shaped compression members, having a narrow end and a concave end, a threaded member, and an alignment rod, wherein the first and second lunate shaped compression members comprise a compression pad disposed of on the top of the concave end of the compression member and a threaded receptacle for receiving a threaded member at the opposing narrow end of the lunate shaped member, and further comprising a U-shaped clip disposed of at the concave end of the lunate shaped member, wherein said U-shaped clip is disposed of parallel to the threaded receptacle and suitable for receiving an alignment rod in said U-shaped openings;

b. rotating said lunate shaped members to increase or decrease the distance between the opposing concave ends;

c. attaching said alignment rod into said U-shaped clips;

d. positioning said first and second concave ends between a player's left and right legs so that first and second ends are secured just above the left and right knee joints of said legs, wherein said alignment rod is extended beyond the knees of the user;

e. aligning the alignment rod towards the target; and f. performing a putting stroke, wherein the player's legs are stabilized throughout the entirety of the putting stroke.

9. A golf swing training aid to stabilize the lower body throughout a putting stroke comprising: an elongate body with a first and second lunate shaped compression members having a narrow end and a wide end, a threaded member, and an alignment rod, wherein the first and second lunate shaped compression members comprise a compression pad disposed of on the lunate shaped end of the compression member and a threaded receptacle for receiving a threaded member at the opposing narrow end of the lunate shaped member, and further comprising a U-shaped clip disposed of at the wide end of the lunate shaped member, wherein said U-shaped opening is disposed of parallel to the threaded receptacle and suitable for receiving the alignment rod in said U-shaped openings.

* * * * *